US007503670B1

(12) United States Patent
Mengle

(10) Patent No.: US 7,503,670 B1
(45) Date of Patent: Mar. 17, 2009

(54) NOVELTY SPARKPLUG FLASHLIGHT

(76) Inventor: Tobi D. Mengle, 931 Lincoln Rd., Birdsboro, PA (US) 19508

( * ) Notice: Subject to any disclaimer, the term of this patent is extended or adjusted under 35 U.S.C. 154(b) by 216 days.

(21) Appl. No.: 11/489,972

(22) Filed: Jul. 20, 2006

Related U.S. Application Data

(60) Provisional application No. 60/700,854, filed on Jul. 21, 2005.

(51) Int. Cl.
*F21L 4/04* (2006.01)

(52) U.S. Cl. ..... 362/202; 362/806

(58) Field of Classification Search ..... 362/157, 362/202–207, 806
See application file for complete search history.

(56) References Cited

U.S. PATENT DOCUMENTS

| | | | | |
|---|---|---|---|---|
| 5,173,073 | A | 12/1992 | Franzone | |
| 5,434,761 | A | 7/1995 | Lesnick et al. | |
| 6,142,894 | A | 11/2000 | Lee | |
| 6,247,991 | B1 | 6/2001 | Chen | |
| 6,644,833 | B1 | 11/2003 | Fu | |
| 6,682,202 | B2 | 1/2004 | Wong | |
| 6,699,094 | B1 | 3/2004 | Ward | |
| 6,799,862 | B2 | 10/2004 | Galli | |
| 6,802,755 | B2 | 10/2004 | Walker et al. | |
| 6,808,287 | B2 | 10/2004 | Lebens et al. | |
| 6,841,941 | B2 * | 1/2005 | Kim et al. | 315/86 |
| 6,851,817 | B2 | 2/2005 | Wong | |
| 6,948,827 | B2 | 9/2005 | Tally | |
| 6,955,440 | B2 | 10/2005 | Niskanen | |
| 6,997,772 | B2 | 2/2006 | Fong | |
| 7,048,407 | B2 | 5/2006 | Kumthampinij et al. | |
| 7,293,893 | B2 * | 11/2007 | Kim | 362/205 |
| 2003/0085242 | A1 | 5/2003 | Texidor | |
| 2005/0231961 | A1 | 10/2005 | Mahoney | |
| 2006/0146525 | A1 | 7/2006 | Chernick et al. | |

* cited by examiner

*Primary Examiner*—Sandra O'Shea
*Assistant Examiner*—Jason Moon Han
(74) *Attorney, Agent, or Firm*—Wendy W. Koba

(57) ABSTRACT

A novelty flashlight in the form of a sparkplug, with a set of LEDs (or other appropriate light emitting devices) included in the conventional "spark" emitting end of the plug. A battery source and micro-controller are included within the sparkplug housing and used to turn the LEDs "on" and "off". In particular, the LEDs may be controlled to strobe at a rate that simulates the actual sparking of an automotive sparkplug. Alternatively, the pulsing of the LEDs may be fast enough such that the LEDs appear to be always "on". An activation button is included on the outer housing the sparkplug for a user to control the operation of the flashlight.

8 Claims, 3 Drawing Sheets

NOVELTY SPARKPLUG FLASHLIGHT

CROSS-REFERENCE TO RELATED APPLICATION

This application claims the benefit of U.S. Provisional Application No. 60/700,854, filed Jul. 21, 2005.

TECHNICAL FIELD

The present invention is related to a novelty flashlight and, more particularly, to a novelty flashlight in the form of a sparkplug, utilizing a plurality of light emitting diodes (LEDs) or other suitable miniature lighting devices as the light source.

BACKGROUND OF THE INVENTION

Many types of novelty flashlight devices have been developed and are considered as the prior art. U.S. Pat. No. 6,682,202 issued to W. K. Wong on Jan. 27, 2004 discloses one such novelty light source that includes lighting elements and a flashing circuit to selectively provide lightly signals, with a spring switch to activate the flashing circuit. The Wong novelty device is designed to take the form of a pen, a key chain, a hair clip or a cosmetic case. U.S. Pat. No. 6,699,094 issued to M. J. Ward on Mar. 2, 2004 discloses a toy figurine flashlight where the figurine body represents a cartoon figure having a torso with a helmet and having arms and legs coupled to the torso. A tri-colored LED unit is mounted in the helmet of the Ward toy figurine flashlight for projecting light through the helmet, selectably in three different colors. A "squeeze" novelty flashlight is disclosed in U.S. Pat. No. 5,434,761 issued to D. Lesnick et al. on Jul. 18, 1995, where the Lesnick et al. novelty flashlight comprises a deformable body in the shape of a novelty character, wherein the manual squeezing of the body activates the LED flashlight.

At least one novelty object based upon a sparkplug has been found in the prior art, comprising a wheeled sparkplug toy vehicle, disclosed in U.S. Pat. No. 5,173,073, issued to V. E. Franzone on Dec. 22, 1992. The Franzone novelty item includes a used electronic sparkplug for a body, a pair of front wheels attached to the contact terminal end of the sparkplug and a pair of rear wheels attached to the shank end of the sparkplug.

SUMMARY OF THE INVENTION

The present invention relates to a novelty flashlight arrangement and, more particularly, to a novelty flashlight in the form of a sparkplug, utilizing a plurality of light emitting diodes (LEDs), lasers, or other suitable miniature lighting elements as the light source. The LEDs/lasers are placed in an assembly in the shape of a spark plug, in association with a power source, micro-controller, control button, printed circuit board and LED/laser supports.

In accordance with the present invention, the micro-controller is used to program the pulsing from the control circuit to turn the LEDs "on" and "off", allowing the user to vary the flashing pattern of the lights. Possible lighting effects include, but are not limited to, continuous light from all of the LEDs or individual LEDs, pulsing all or individual LEDs at a frequency to simulate the "spark" of a sparkplug, pulsing of all or individual LEDs at a strobe frequency, and the like. The colors of the lights may be varied as well.

Other and further applications and embodiments of the present invention will become apparent during the course of the following discussion and by reference to the accompanying drawings.

BRIEF DESCRIPTION OF THE DRAWINGS

Referring now to the drawings.

DETAILED DESCRIPTION

Figure 1:
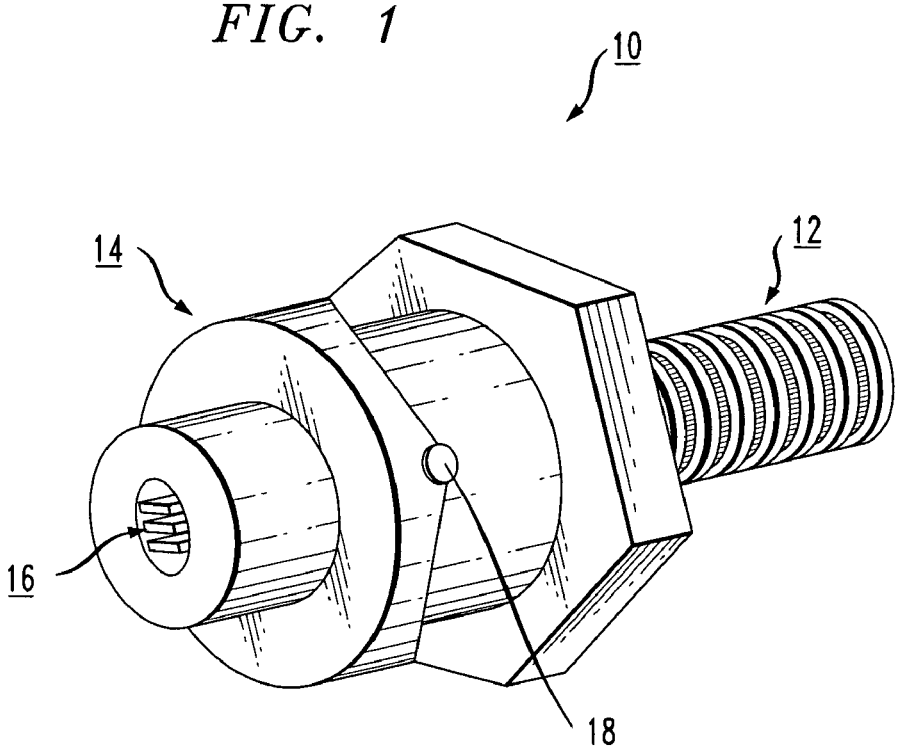
FIG. 1 is an isometric view of the sparkplug flashlight of the present invention.

FIG. 1 is an isometric view of an exemplary sparkplug flashlight 10 formed in accordance with the present invention. As shown sparkplug flashlight 10 includes a threaded member 12 that would be attached to an engine block if used as a conventional sparkplug and a housing member 14 that is used to encase the flashlight components of the present invention. In the particular embodiment of FIG. 1, housing member 14 supports a plurality of three separate light sources 16 in the form of LEDs. An "on"/"off" actuator button 18 is included on housing member 14 and used by an individual to control the operation of flashlight 10. As described further below, by depressing button 18, LEDs 16 are activated to turn "on", further activation of button 18 can then be used to change the flashing/strobing rate of each individual LED 16. Much like a cell phone's "power" button, activation button 18 can, for example, be pressed once to begin operation, then pressed again to change to the next function (such as strobe rate), and pressed and held for a period of time to turn flashlight 10 "off". It is to be understood that the material used to form threaded member 12 and housing member 14 may be any suitable material used to fabricate a flashlight and does not need to be the materials generally used to form an actual sparkplug. Additionally, various intricate features of an actual sparkplug are not required to be included in the form of the present invention, as long as the general housing mimics the design of an automotive sparkplug.

Figure 2:
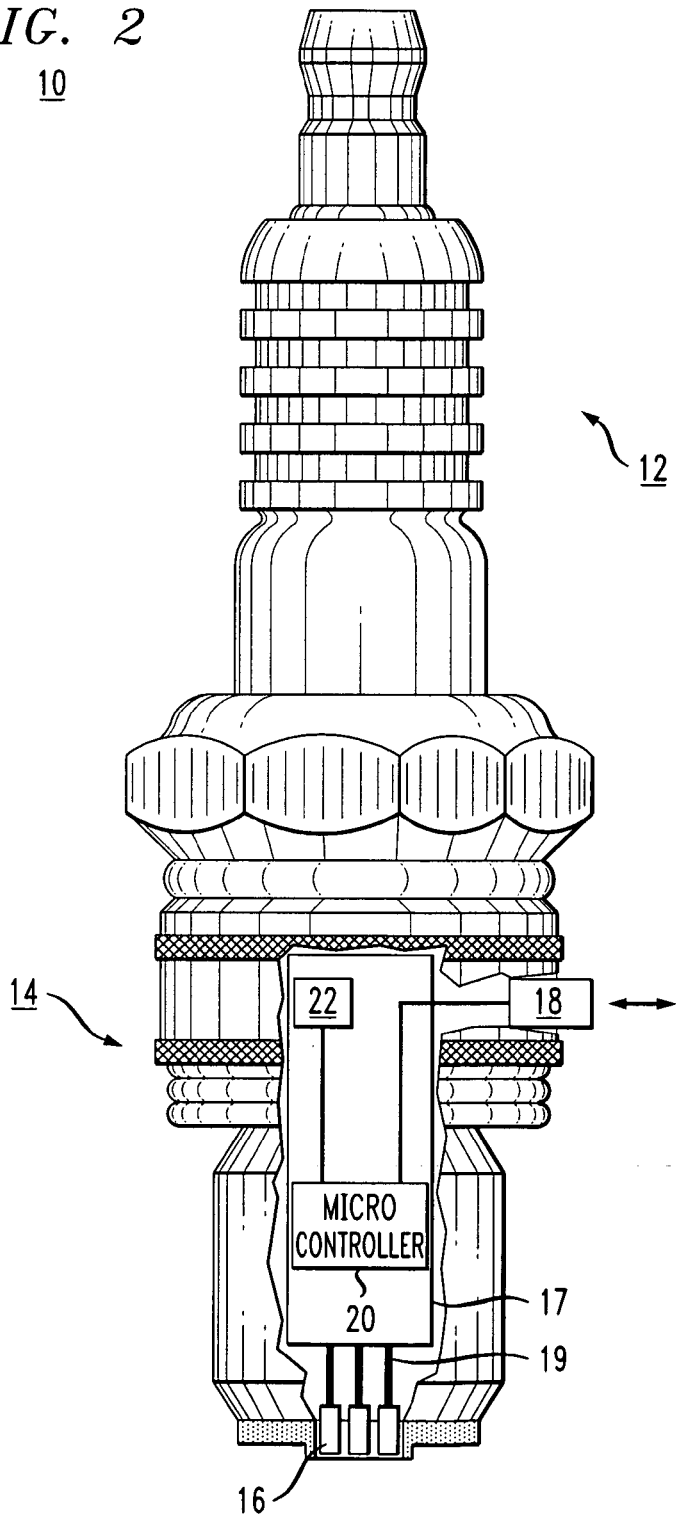
FIG. 2 is a cut-away side view of the flashlight of FIG. 1, showing the location of the various components of the flashlight within the assembly.

FIG. 2 is a cut-away side view of flashlight 10 of FIG. 1, showing in particular a printed circuit board (PCB) 17 supporting a micro-controller 20, where micro-controller 20 is coupled to activation button 18. A set of posts 19 extend from PCB 17 and are used to support LEDs 16 in the desired terminal opening of housing member 14. Micro-controller 20 (a conventional component) is programmed in a manner well-known in the art to output varying electrical pulse frequencies to turn the individual LEDs 16 "on" and "off". A battery power source 22 is included with housing member 14 (and may optionally be positioned on PCB 17) and used to power micro-controller 20 and illuminate LEDs 16. Possible light effects include, but are not limited to: (1) continuous light from all LEDs, (2) pulsing of all or individual LEDs at a strobe frequency (similar to an automotive "strobe tachometer") to freeze the motion of a rotating or moving objection, (3) pulsing all or individual LEDs based on an electrical or radio frequency signal (such as from an MP3 player, iPOD or the like), such that the LEDs appear to pulse in synchronization with the music. The various light sources may all emit the same color light or each LED may emit a different color, where the lighting sequence may then also control the sequence of colors "flashed" by flashlight 10.

It is to be understood that LEDs 16 may comprise any desired number of separate LED elements—from a single LED to several separate LEDs. The LEDs may all emit the same color, or may be of different color, as mentioned above. The physical sizes of LEDs 16 may also be varied, at the discretion of the builder. Most broadly, as stated above, other types of suitable light sources may also be used, such as miniature light bulbs, lasers, or other suitable light sources that may be operated by battery.

Figure 3:
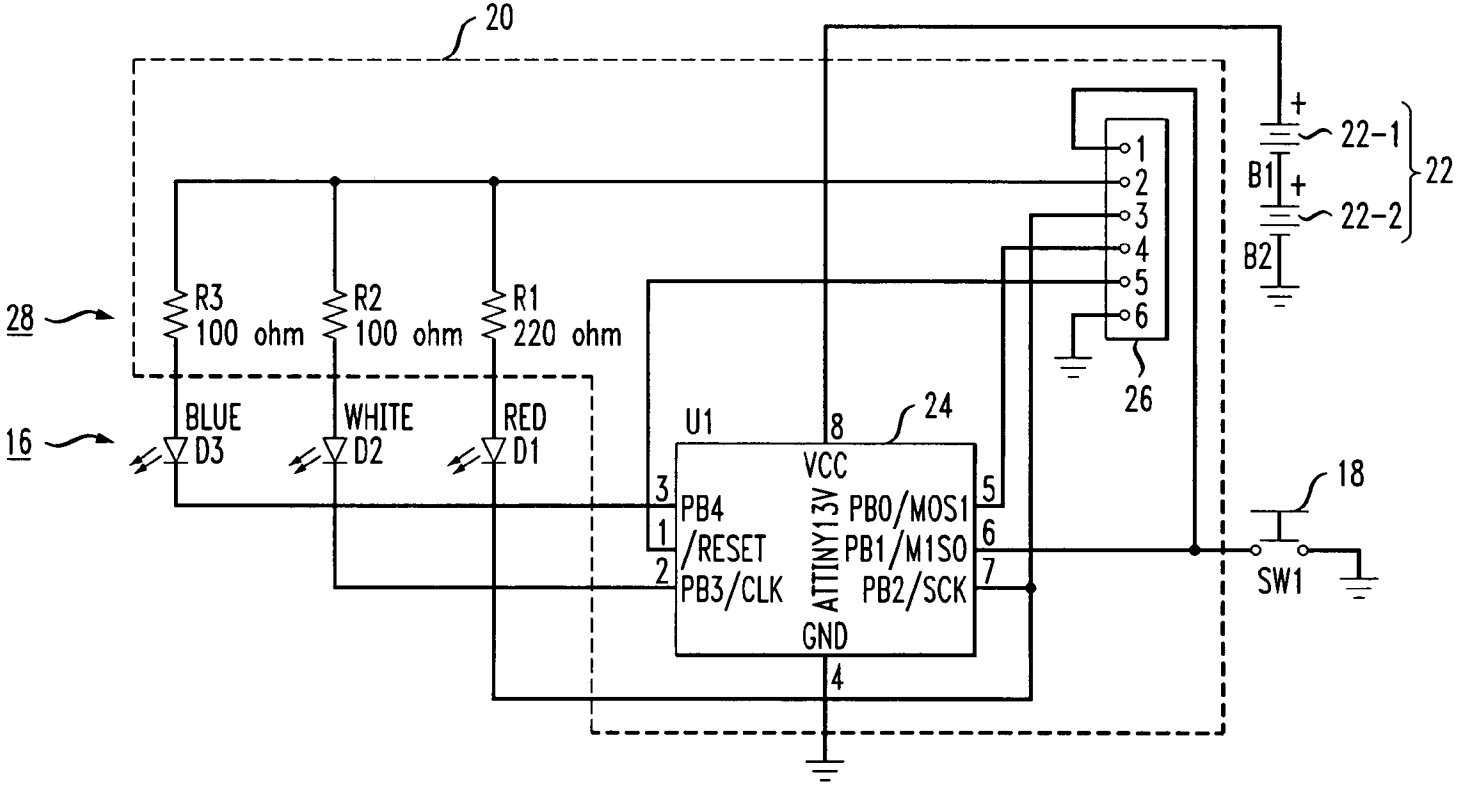
FIG. 3 is a schematic diagram of the flashlight assembly of the present invention.

FIG. 3 contains an exemplary schematic illustrating the relationship between the various components of flashlight 10. It is to be understood that this specific circuit embodiment is exemplary only, and in its broadest form the flashlight of the present invention embodies any arrangement for controlling the activation of miniature light elements within a sparkplug-shaped housing, where the lighting is controlled to provide different effects, such as "sparking" or "strobing". If the pulse frequency is faster than the human eye frame rate, the LEDs will appear to be "on" in a continuous fashion. If the pulse frequency is slower than the human eye frame rate, the LEDs will appear to pulse "on" and "off", similar to a conventional sparkplug in its normal internal combustion engine applications.

In particular, FIG. 3 illustrates LEDs 16, actuator button 18 and battery 22 (in this case, illustrated as a pair of series-connected battery sources 22-1 and 22-2). Micro-controller 20 is shown as including a programmable processor 24, which receives energizing power from battery 22. An input from actuator button 18 is used to initiate the operation of processor 24. Processor 24 is also coupled, through separate lead lines, to each individual LED 16. An internal connector 26 is coupled to both actuator button 18 and processor 24 to allow for micro-controller 20 to be re-programmed as desired without requiring the removal of any of the components. A set of current-limiting resistors 28 is coupled between the individuals LEDs and connector 26.

While there is shown and described herein certain specific structures embodying the present invention, it will be apparent to those skilled in the art that various modifications and re-arrangements of the elements may be made without departing from the spirit and scope of the underlying inventive concept, and that the same is not limited to the particular forms herein shown and described except insofar as indicated by the scope of the claims appended hereto.

What is claimed is:

1. A flashlight assembly comprising:

an automotive sparkplug body comprising a threaded member and a housing member disposed contiguous with the threaded member;

at least one miniature light emitting device disposed within the housing member to emit light from the sparkplug body;

an activation button formed within the surface of the sparkplug body to control the operation of the at least one miniature light emitting device;

a battery power source disposed within the housing member and coupled to the at least one miniature light emitting device; and a micro-controller disposed within the housing member and coupled between the at least one light emitting device and the activation button, with the battery power source providing power thereto, the micro-controller configured to operate the at least one miniature light emitting device to provide a controlled pulsing output.

2. The flashlight assembly as defined in claim 1 wherein the at least one miniature light emitting device comprises a plurality of light emitting devices.

3. The flashlight assembly as defined in claim 2 wherein the plurality of light emitting devices are configured to emit light of different colors.

4. The flashlight assembly as defined in claim 1 wherein the micro-controller is configured to further provide a pulse rate of a frequency great enough always "on".

5. The flashlight assembly as defined in claim 2 wherein the micro-controller is configured to selectively activate separate ones of the plurality of light emitting devices.

6. The flashlight assembly as defined in claim 1 wherein the at least one light emitting device comprises a light emitting diode (LED).

7. The flashlight assembly as defined in claim 1 wherein the at least one light emitting device comprises a laser.

8. The flashlight assembly as defined in claim 1 wherein the at least one light emitting device comprises a miniature light bulb.

* * * * *